US005701937A

United States Patent [19]

Bourboulou et al.

[11] Patent Number: 5,701,937

[45] Date of Patent: Dec. 30, 1997

[54] FLUID DISTRIBUTION SYSTEM

[75] Inventors: Yves Bourboulou, Rilhac-Rancon; Micheline Boucheteil, Saint-Yrieix-sous-Aixe; Céline Philippon, Limoges; Jean Tronchet, Couzeix, all of France

[73] Assignee: Pharmacia & Upjohn Aktiebolag, Stockholm, Sweden

[21] Appl. No.: 432,127

[22] PCT Filed: Nov. 8, 1993

[86] PCT No.: PCT/SE93/00934

§ 371 Date: Sep. 19, 1995

§ 102(e) Date: Sep. 19, 1995

[87] PCT Pub. No.: WO94/10965

PCT Pub. Date: May 26, 1994

[30] Foreign Application Priority Data

Nov. 9, 1992 [SE] Sweden ..... 9203330-7

[51] Int. Cl.[6] ..... A61J 1/05

[52] U.S. Cl. ..... 141/244; 41/9; 41/10; 41/18; 41/100; 41/313; 41/324; 41/325

[58] Field of Search ..... 141/2, 9, 10, 18, 141/21, 114, 100, 102, 104, 234, 236, 237, 240, 242–244, 246, 313, 314, 317, 324–326; 604/408, 410

[56] References Cited

U.S. PATENT DOCUMENTS

| | | | |
|---|---|---|---|
| 2,884,021 | 4/1959 | Ginsburg | 141/236 X |
| 3,187,750 | 6/1965 | Tenczar, Jr. | 604/410 |
| 3,536,449 | 10/1970 | Astle | 141/237 X |
| 3,566,930 | 3/1971 | Kirschner | 141/244 |
| 3,670,785 | 6/1972 | Heiss et al. | 141/9 |
| 4,270,584 | 6/1981 | Van Lieshout | 141/237 X |
| 4,326,526 | 4/1982 | Buck et al. | 604/410 X |
| 4,428,745 | 1/1984 | Williams | 604/410 X |
| 5,058,631 | 10/1991 | Grant | 141/10 |
| 5,168,905 | 12/1992 | Phallen | 141/237 X |
| 5,257,985 | 11/1993 | Puhl | 604/410 |
| 5,289,858 | 3/1994 | Grabenkort | 141/114 X |
| 5,308,334 | 5/1994 | Sancoff | 604/410 X |
| 5,404,922 | 4/1995 | Sliter | 141/237 |
| 5,509,898 | 4/1996 | Isono et al. | 604/410 X |

FOREIGN PATENT DOCUMENTS

| | | |
|---|---|---|
| 0 455 215 A2 | 6/1991 | European Pat. Off. . |

*Primary Examiner*—J. Casimer Jacyna
*Attorney, Agent, or Firm*—Pollock, Vande Sand & Priddy

[57] ABSTRACT

Provided is a closed fluid distribution system with manifold devices for aseptically distributing fluids in conduits from a controlled atmosphere zone for production of the fluids to collapsible storage containers located outside the zone. The manifold device facilitates filling of a plurality of containers with one or several compartments. The invention is especially advantageous when regarding that the system can be used for aseptically filling both one-, two- or three-compartment containers for storage, with possibilities of switching between the types of containers.

9 Claims, 2 Drawing Sheets

FLUID DISTRIBUTION SYSTEM

FIELD OF INVENTION

The present invention is directed to aseptically distributing sensitive fluids in conduits from a controlled atmosphere zone for their production by the means of manifold devices to containers for storing the said fluids, located outside the said zone,

DESCRIPTION OF THE INVENTION

Technically, a difficult problem is a encountered when aseptically distributing fluids from a dosed or sterile production zone to sterile sealable containers for storing the fluids. To maintain the highest possible grade of protection of the fluids is especially critical when handling sterile parenterally administerable fluids of nutrients and/or medicaments. In such cases the containers are preferably either filled immediately after preparation of the fluids or filled at the place at which they are used, i.e. hospitals and special centers. The preparation of the fluids and the filling of the storage containers must be performed under the highest possible sterile conditions. The content of the containers must otherwise be consumed within a very short time.

In many previous process the containers have been filled one at the time inside a sterile isolator zone, which is time consuming, inconvenient and expensive.

The object of the present invention is to provide a dosed aseptic fluid distribution system for delivering fluids from a controlled atmosphere zone, in which the fluids are prepared with a high grade of sterility, to containers for storage of the fluids, while maintaining the same protection in a lower grade sterility environment.

The invention is directed to a dosed aseptic system for aseptically distributing at least one sensitive fluid through conduits from a controlled atmosphere zone adapted to sterile production to single- or multi-compartment containers for storage of the fluid or fluids outside the said zone by one or several of the said manifold device. Especially preferred fluids to be handled by the system are parenterally administerable medical and/or nutritional fluids to be stored in collapsible or flexible containers.

The invention also relates to manifold devices which connects the conduits leading from a controlled atmosphere zone to containers for storage of the fluids. The manifold devices can distribute the fluids for simultaneous filling of several compartments of each container or in a special embodiment simultaneously fill all the containers. The manifold devices also provide convenient means of switching between different types of containers in a simple and efficient manner. Each manifold device has a singular inlet sealingly connected to a conduit for the distribution of one determined fluid from the sterile controlled atmosphere zone and it is provided with a plurality of fluid outlet orifices, each connected to a designated chamber of the container by a sealed tubing.

Another aspect of the invention is to provide methods for aseptically filling containers with fluids distributed from a controlled atmosphere zone for their production, to designated compartments in containers outside said zone, by means of the said manifold devices.

Each manifold device can be constructed so that the fluid flow is substantially the same in each of the tubings connecting the fluid outlet orifices of the manifold device to the compartments of the containers, during the filling.

The manifold devices can be provided with attachment means for the connection of several manifold devices, especially when the fluids are distributed to multi-compartment containers. Alternatively, they can be constructed as series of parallel, identical manifold devices in a pre-formed assembly. The manifold devices can also be assembled in a housing with arrangements to sealingly connect the outlet orifices of the manifold device to the tubings leading to the compartment or the compartments of the containers.

According to a special embodiment of the invention the manifold device can be adapted to simultaneous filling of all the containers connected thereto, by being constructed so that the pressure drop is substantially the same in all the outlet orifices.

The manifold device facilitates filling of a plurality of containers with one or several compartments. The invention provides a simple and convenient system for aseptical filling of single- or multi-compartment containers with fluids to be used for parenteral administration which readily enables switching between different types of containers. The further advantages and applications will become apparent in the detailed description of the invention.

DETAILED DESCRIPTION OF THE INVENTION

The fluids to be distributed with the manifold device to the containers are prepared in a controlled atmosphere zone, not shown in any of FIGS. 1–7 The controlled atmosphere zone is a space wherein a high grade of sterility is maintained by conventional means, for example by a protective laminar flow or by a physically delimiting isolator zone. Such means and methods are well-known for the person skilled in this technical field and will not be further discussed here.

The fluids are preferably any types of medical and/or nutritional fluids used in parenteral administration. Examples of such fluids are fatty emulsions, solutions of glucose and/or other sugars or carbohydrates, solutions of amino adds, electrolytes or trace elements or other infusion solutions containing therapeutically or diagnostically useful components. The mentioned solutions can be mixed in a variety of combinations with different shelf-life, determined by the manufacturer. In some applications all ingredients are mixed to form a preparation for total parenteral nutrition and in such cases it is distributed by one or several conduits through one or several manifold devices to single-compartment containers. In other applications several different solutions can be prepared in the controlled atmosphere zone and each solution will be distributed in a specific conduit to a specific manifold device which distributes it to a designated compartment of multi-compartment containers.

Figure 1:
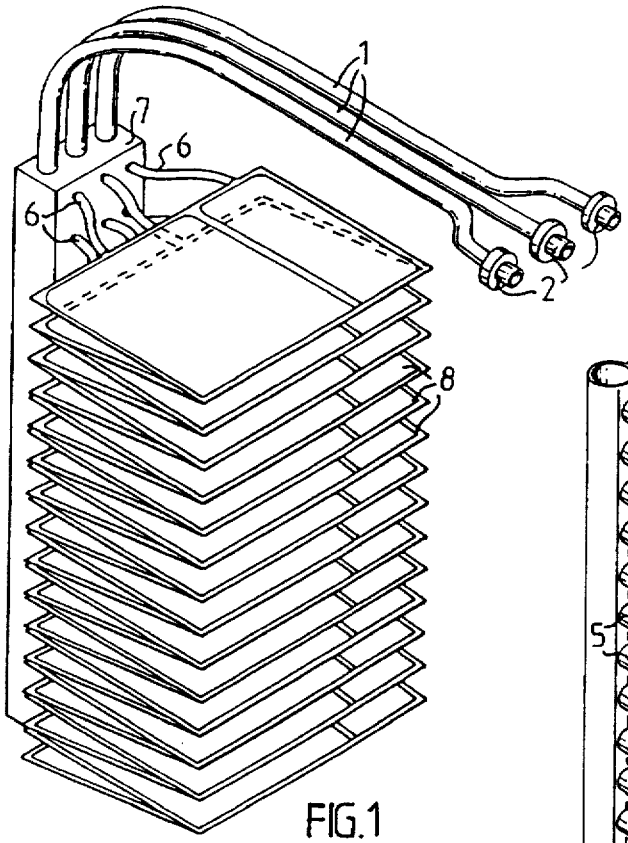
FIG. 1 shows an aseptic fluid distribution system according to the invention where three fluid conduits distribute three different fluids to folded three-compartment containers.
Figure 2:
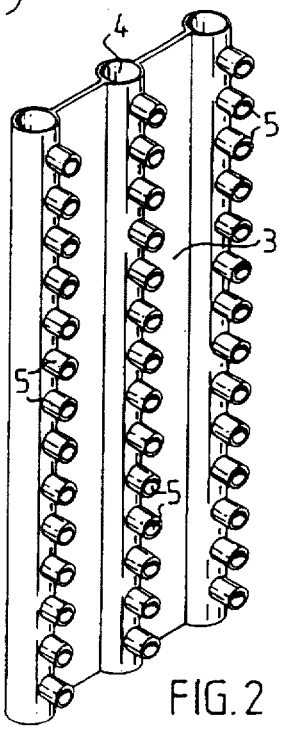
FIG. 2 shows manifold devices used in the system illustrated in FIG. 1. The manifold devices are attached to each other in an assembly for distributing fluids to three-compartment containers.
Figure 3:
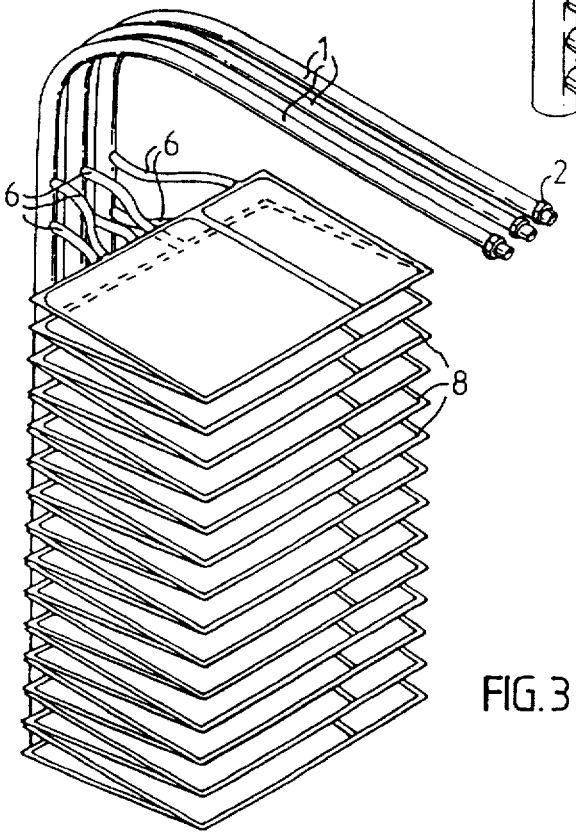
FIG. 3 shows another fluid distribution system for three-compartment containers. The manifold devices are separated and not assembled in a housing in this modified system.
Figure 4:
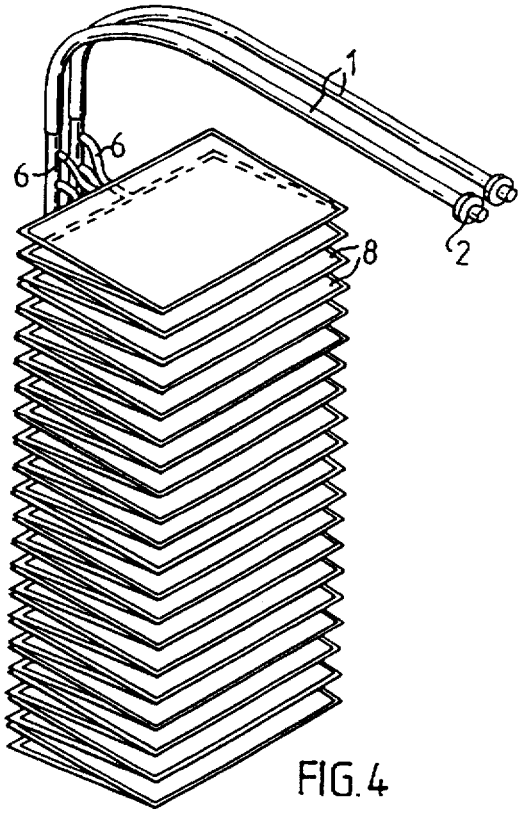
FIG. 4 shows a fluid distribution system with separated manifold devices for distribution of two different fluids to two-compartment containers.

Referring to FIGS. 1 and 2 the conduits (1) preferably are tubes made of polymeric materials compatible with medical and/or nutritional fluids and which are able to withstand conventional sterilizing conditions. The conduits can also have the form of multi-channel tubes. The fluid distribution system comprising conduits (1), manifold devices (3), optionally assembled in a housing (7), and tubings (6) with attached containers (8), preferably is enveloped in a protective package and sterilized by conventional methods, such as ethylene oxide sterilization or gamma radiation, before coupling the system to conduits leading from the sterile isolator zone. Each conduit of the fluid distribution system is provided with a sterile filter (2) with pore size of about 0.2 μ, so as to maintain the sterility of the system. The conduits (1) are connected to the inlets of the manifold devices (4) by connection means, so as to provide a dosed fluid delivery system and maintain highest possible sterility. In a simple form the connection means may consist of a glue that sealingly connects the conduits with the fluid inlets of the manifold device. There can be arranged valve mechanisms in any of the conduits for regulating the fluid flow in the manifold device inlet.

As best seen in FIG. 2, the manifold devices (3) have a singular fluid inlet at the top of each device (4) and a plurality of fluid outlet orifices (5). The outlet orifices are intended to be sealingly connected to tubings (6), (see FIG. 1), for distributing the fluid to its designated compartments in the storage containers. The connection between the fluid outlet orifices and the tubings can be sealed in the same manner as the connection between the conduits and inlets, so as to ensure that the fluids never will be exposed to the surroundings. Each of the tubings (6) leading from the outlet orifices of the manifold device will be dosed by pinching means, not shown in the figures, which can be opened or removed when one or several fluids shall be distributed to a desired container.

The manifold devices can be assembled in an integrated structure as in FIG. 2, which may be injection moulded in one piece in a suitable polymer material, such as PVC, polycarbonates, MBS- or ABS-polymers (methyl/acrylonitrile butadiene styrene copolymers) or moulded in stainless steel some other easily sterilizable material or assembled in the production plant by attachment means (not shown in the figures). Alternatively, the manifold devices can be manufactured individually as mentioned and kept apart from each other during the fluid distribution by attachment means or by some other devices suitable for the purpose. In both cases the manifold devices can be assembled in a housing (7), which includes means that will provide a dosed communication between the outlet orifices and the tubings.

It is to be understood that the alternative embodiments of the manifold devices are conceivable to use in the system as long as they fulfill the criteria as set out in the following part of the description.

To perform an acceptable fluid distribution from the sterile preparation zone to the compartments of the containers the fluid, it is necessary to keep the fluid from exposure to the outside environment and to maintain the same fluid flow in the fluid outlet orifices connected to the tubings, in each of the manifold devices to the correspondent compartments of the containers. If the last criterion is not fulfilled, the compartments of the containers will be filled with different volumes of fluids.

The design of the manifold devices is of great importance to the function of the invention. The most important parameters are the relation between the fluid inlet diameter and the diameters of the fluid outlet orifices as well as the distance or spacing between the outlet orifices. The number of fluid outlet orifices (i.e. the number of containers to be filled by the system), the inlet fluid flow and the viscosity of the fluids are naturally also important for the performance of the system. In certain applications it is preferable to have a relation between the fluid inlet diameter and a fluid outlet orifice diameter of about 4:3 in the manifold devices.

Figure 6:
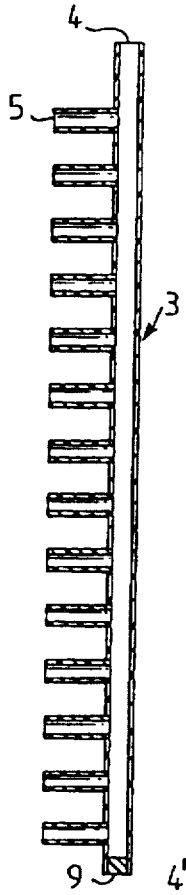
FIG. 6 shows a section of a manifold device according to the invention.
Figure 5:
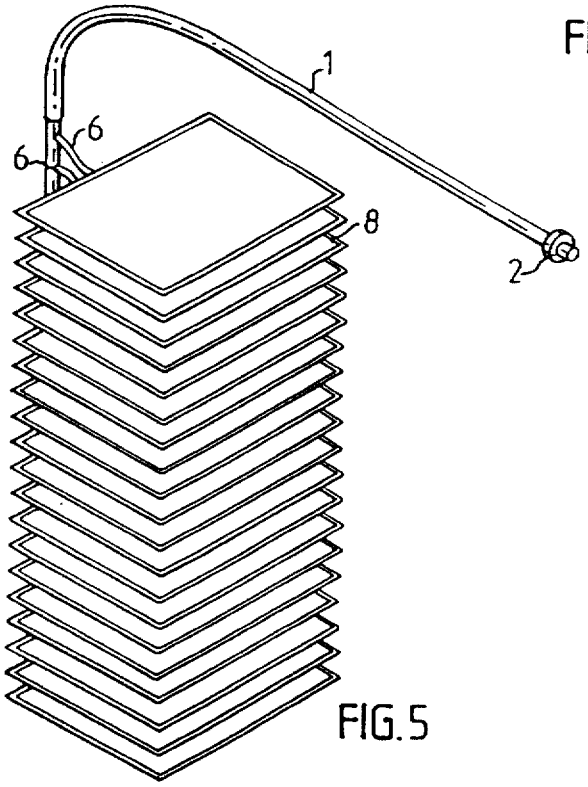
FIG. 5 shows a fluid distribution system similar to those in FIGS 3 and 4, but with a manifold device adapted for single-compartment containers.

According to one non-limiting embodiment of the invention, as shown in FIG. 6, a manifold device will have 14 outlet orifices, each with a diameter of 4 mm. The inlet diameter of the manifold device is 6 mm. The distances between the outlet orifices are 16 mm. In the following Examples it is shown that a manifold device can be used in an aseptic bag filling system with excellent results.

When operating the dosed aseptical system for distributing several fluids for separate filling and storage in multi-compartment containers with the manifold devices according to the invention, each of the fluids will be delivered from the preparation procedure in the controlled atmosphere zone by pumps in specific conduits connected to their designated conduits (1) leading to the inlet (4) of a designated manifold device. The multi-compartment containers are sealingly connected with the outlet orifices of the manifold devices by the tubings, which initially are closed by pinching means, so that each fluid can be delivered to its designated compartment.

When filling the first container, which is positioned the longest distance from the manifold inlets, the pinching means are dislocated from each of the tubings leading to the first container and the fluids are introduced in the compartments simultaneously. The second container can thereafter be filled in the same manner, which is successively repeated when filling the rest of the containers in an order directed towards the inlet of manifold device. The filled containers are thereafter sealed, for example by welding, and disconnected from the tubings, either one by one, immediately after their filling or all at once after they have all been filled. The choice of routine will be dependent of the bulkiness of the filled containers. There are no obvious limitations in the number of containers to be fried, otherwise than their bulkiness, which tends to demand longer connecting tubings to the manifold device. Such a measure may, however, influence the accuracy of the filling volume. A number of about at least 10 to 20 containers connected to each manifold device can be handled with excellent filling performance.

The manifold device can be placed vertically as shown in FIGS. 1 to 7, but in certain applications the best operation mode of the aseptic system is to have the manifold placed in a horizontal position.

As mentioned in the foregoing part, the fluid distributing system will be sterilized before its conduits are connected to conduits leading from the controlled atmosphere zone adapted to sterile production. The connection of conduits takes place either inside the zone or in an area connected to the zone with the highest possible grade of sterility. The zone can include fermentation tanks.

Figure 7:
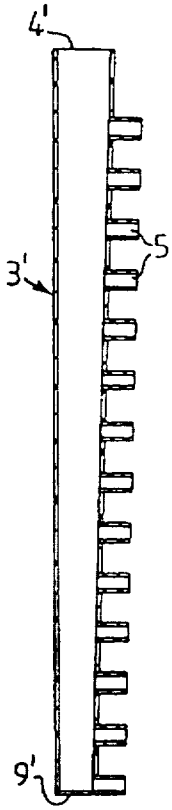
FIG. 7 shows a section of modified manifold device designed so that the pressure drop becomes substantially equal in all the outlet orifices.

In another special embodiment of the invention, schematically shown in FIG. 7, the manifold device is adapted to simultaneous filling of all the containers connected to the outlet orifices. A manifold device to fulfill this requirement shall have substantially the same pressure drop in all the outlet orifices (5'), which shall be repeatable from one filling sequence to another, and substantially the same pressure shall prevail in the manifold. To obtain such conditions there must be similar or substantially similar hydrodynamical conditions near and in all the outlets orifices. It is therefore important that all orifices are positioned with the same angle in relation to the main manifold tubing, and that all outlet orifice have the same cross-sectional area, length and smoothness, as well as carefully considering the design of all the transitional surfaces. In such a manifold device, the cross-sectional area of the inlet (4') to the manifold device shall be sum of all the areas of outlet orifices (5'). The manifold device shall preferably be placed horizontally when filming the containers to ensure that mentioned conditions are maintained.

In an example of such a manifold for simultaneous filling of 14 containers, the inlet can have a diameter of 15 mm and the end diameter can be 10 mm. The orifice diameters can thus be 3 mm each, so that the sum their area will exceed the cross-sectional area of the manifold device inlet. This will give the manifold device a cross-sectional shape vaguely in the shape of a truncated cone, as shown in FIG. 7. The degree of filling of the containers will be simple to control by time regulation by, for example a valve mechanism arranged in a suitable position of the aseptic system, which terminates the flow.

In still another embodiment of the invention one or several of the manifold devices as shown in FIG. 2 can be provided with rows of fluid outlet orifices distributed around the periphery of the manifold device, thus enabling the fluid to be distributed to even more containers. This will of course demand a careful consideration of the above mentioned parameters.

According to the present invention the manifold devices will enable the system to be readily rearranged from distribution of fluids to and the filling of one- to two- to three compartment containers and vice versa, while keeping the system sealed to the highest possible manner. It is conceivable to extend the number of compartments to be filled from the system by extending the number of corresponding conduits and manifold devices, even through one- two or three-compartment containers have been chosen as illustrating examples in the Figures.

It is be possible to find numerous applications within the scope of the present invention. For example the fluid distribution to the three-compartment containers can, as shown in FIG. 1 and 2, readily be changed to, for example, distribution to a set of single-compartment containers and a set of two-compartment containers, or changed to the distribution and filling of three sets single-compartment containers.

Anyone skilled in the art will fully realise the number of possibilities that becomes feasible in aseptic fluid distribution to, and aseptic filling of, single- or multi-compartment containers especially with parenteral fluids according to the present invention.

The containers, to which fluids are delivered by the manifold devices are preferably made of collapsible polymer material and are preferably, as discussed above and shown in the FIGS. 1, 3, 4, and 5 of a one- or two- or three-compartment bag type. Preferably the containers will have the form of flexible bags are made of EVA ((Poly-)Ethylene Vinyl Acetate), to which the tubings leading from the fluid outlet orifices are sealingly connected. The bags will sealed by welding before the tubings are disconnected from outlet orifices of the manifold devices. The fluids will thus be filled in the containers in a closed system without exposure to the environment. The invention is not intended to be limited to flexible or collapsible bags of polymeric materials and it will be applicable on a broad range of containers provided that they are sealable without breaking the closed system.

EXAMPLE 1

In a model of the aseptic fluid distribution system for distributing fluids (water) to 14 attached single-compartment containers, numbered A, B, C, D, . . . ,G, H, . . . M, to N, the manifold device is 25.9 cm long and has an internal and an external diameter of 0.6 cm and 0.8 cm, respectively. The outlets orifices of the manifolds will have an internal and an external diameter of 0.4 cm and 0.6 cm, respectively, and the distance between the 14 orifices will be 1.3 cm.

The fluids are distributed from a tank having a pressure of 1 bar and have a temperature of 17° C. The content of the first (A), the last ON) and a middle container (H) are weighed after a suitable running time. The mean value (volume in grams) of at least three test performances, for each of the three container is calculated and thereafter calculated as a mean value for all three containers, which is shown in the following table, together with a maximum difference value for each experimental group.

| Experiment Number | Position of the manifold | Mean vol. in grams | σ(n-1) | Max–Min | Length of tubings (cm) |
|---|---|---|---|---|---|
| 1 | horizontal | 710.5 | 1.87 | 5 | 154 |
| 2 | vertical | 707.33 | 1.86 | 5 | 154 |
| 3 | horizontal | 692.5 | 2.21 | 18 | 154 |
| 4 | vertical | 705.83 | 3.60 | 9 | 154 |
| 5 | horizontal | 795.33 | 2.80 | 8 | 83 |
| 6 | vertical | 792.50 | 7.53 | 18 | 83 |
| 7 | horizontal | 795.00 | 3.79 | 10 | 83 |
| 8 | vertical | 789.83 | 6.61 | 16 | 83 |

EXAMPLE 2

This example intends to show the function of the aseptic fluid distribution system. The manifold device has the same dimensions as disclosed above, in Example 1, but is made of rigid PVC, instead of stainless steel. The 14 flexible containers to be filled have three compartments C1, C2 and C3 with different sizes. A water solution of ambient temperature is employed for test.

| Bag No. | solution total weight (g) | C1 large compartment (g) | C2 small compartment (g) | C3 medium compart. (g) |
|---|---|---|---|---|
| 1. | 2026 | 1588 | 230 | 228 |
| 2. | 2086 | 1588 | 250 | 248 |
| 3. | 2081 | 1587 | 247 | 247 |
| 4. | 2083 | 1587 | 249 | 247 |
| 5. | 2087 | 1587 | 252 | 248 |
| 6. | 2087 | 1588 | 251 | 248 |
| 7. | 2099 | 1588 | 258 | 253 |
| 8. | 2108 | 1587 | 262 | 259 |
| 9. | — | 1588 | — | — |
| 10. | 2092 | 1584 | 256 | 252 |
| 11. | 2090 | 1588 | 253 | 249 |
| 12. | 2091 | 1588 | 252 | 251 |
| 13. | 2089 | 1588 | 252 | 249 |
| 14. | 2090 | 1588 | 251 | 251 |
| average weight | 2090.25 | 1587.38 | 252.75 | 250.17 |
| standard deviation | 7.23 | 1.12 | 4.11 | 3.41 |

EXAMPLE 3

In a follow up experiment the same system as in Example 2 was used, but the flexible containers had three compartments, C1, C2 and C3 with the same size. As fluids Intralipid® 20% (a fat emulsion) and a 30% glucose solutions were used.

| Product Bag No. | Intralipid ® 20% C1 (g) | C2 (g) | C3 (g) | glucose 30% C1 (g) | C2 (g) | C3 (g) |
|---|---|---|---|---|---|---|
| 1.* | — | — | — | — | — | — |
| 2. | 251 | 251 | 252 | 248 | 250 | 252 |
| 3. | 250 | 253 | 253 | 249 | 251 | 252 |
| 4. | 251 | 253 | 252 | 248 | 252 | 251 |
| 5. | 251 | 247 | 253 | 247 | 251 | 254 |
| 6. | 250 | 252 | 252 | 249 | 250 | 252 |
| 7. | 249 | 252 | 252 | 248 | 250 | 253 |
| 8. | 251 | 252 | 252 | 248 | 249 | 254 |
| 9. | 251 | 251 | 249 | 247 | 251 | 252 |
| 10. | 251 | 251 | 251 | 248 | 251 | 249 |
| 11. | 250 | 252 | 251 | 248 | 251 | 249 |
| 12. | 250 | 252 | 250 | 248 | 251 | 251 |
| 13. | 252 | 252 | 251 | 248 | 250 | 250 |
| 14. | 250 | 253 | 251 | 249 | 250 | 252 |
| Average weight | 250.5 | 251.6 | 251.5 | 247.7 | 250.5 | 251.8 |
| Standard deviation | 0.8 | 1.6 | 1.1 | 1.0 | 0.8 | 1–4 |

*For this test, the first bag is not filled completely because of the death volume of the system. This bag is used to eliminate "bubbles" and to fill the system.

The Examples is not intended to be limiting, only to show a practically working example of distributing substantially the same volume to the containers. It will not be unduly laborious for anyone skilled in this technique to find out which parameters that are most important for a given fluid in the system, and to choose the appropriate dimensions to achieve the desired properties of the manifold devices and the aseptic system.

Examples 1, 2 and 3 show that the filling reproduction is satisfying in all aspects and the test results are comparable to other fillings which are practice in the industry.

It will be apparent that the aseptical, dosed fluid distribution system and the manifold devices according to the invention afford many important advantages. It is especially favourable to maintain the same level of protection as in the controlled atmosphere zone by the dosed system when exposed to a lower grade atmosphere for distributing fluids, filling and sealing the containers. The system will minimize the environment exposure risk, facilitate handling of system of the system components, increase production capacity without having the cost investments related to controlled atmosphere zones adapted to sterile production. The closed aseptic system according to the invention can be regarded as a advantageous extension of the isolator zone, which overcomes several problems for a more large-scale production of containers with parenterally administerable solutions.

The system and the manifold devices according to the invention can also be suitable to transfer fluids from any protected area with controlled conditions without changing the microbial/chemical status of the fluids by environment exposure. An example where the present invention will be useful is sampling or harvesting of cultures or products from fermentation tanks.

The invention is not limited to the described and illustrated embodiments thereof and modifications and changes can be made within the scope of the following Claims.

What is claimed is:

1. A closed aseptic system for aseptically distributing a plurality of fluids from conduits leading from a controlled atmosphere zone for production of the fluids to containers having several compartments by several manifold devices located outside the said zone characterized in that each manifold device (3, 3') has a singular fluid inlet (4, 4') sealingly connected with a determined conduit (1) for the distribution of one determined fluid, wherein each manifold device is provided with a plurality of fluid outlet orifices (5, 5') sealingly connected to the containers (8) by tubings (6) and wherein, a) the cross-sectional area of said manifold device inlet is selected from the group consisting of being larger than the sum of the cross-sectional areas of said outlet orifices, and b) the relationship of the diameter of the manifold device inlet and a manifold outlet orifices is about 3:2, in order to obtain that (i) the fluid flow is substantially the same in each tubing (6) that connects the outlet orifices of the manifolding device to the containers; and that (ii) the pressure drop is substantially the same in all outlet orifices of the manifold device; and wherein said system is adapted for filling several compartments of the containers simultaneously with different fluids wherein each manifold device is selected from the group consisting of being assembled by attachment means and pre-manufactured in an assembly, so that each fluid will be distributed in its predetermined manifold device to its designated compartment of multi-compartment containers and wherein said multi-compartment containers are collapsible.

2. A system according to claim 1 characterized in that each manifold device is assembled in a housing (7) which includes means for providing closed communication between the outlet orifices of each manifold device and the tubings connected to multi-compartment containers.

3. A system according to claim 2 characterized in that each conduit leading from the controlled atmosphere zone to the manifold device is provided with a sterile filter (2).

4. A system according to claim 3 characterized in that the fluids are parenterally administerable medical, nutritional fluids or both distributed from a controlled atmosphere zone for sterile production of the said fluids.

5. A system according to claim 2 characterized in that the fluids are parenterally administerable fluids selected from the group consisting of medical fluids, nutritional fluids and mixtures thereof distributed from a controlled atmosphere zone for sterile production of the said fluids.

6. A system according to claim 1 characterized in that each conduit leading from the controlled atmosphere zone to the manifold device is provided with a sterile filter (2).

7. A system according to claim 1 characterized in that each conduit leading from the controlled atmosphere zone to the manifold device is provided with a sterile filter (2).

8. A system according to claim 7 characterized in that the fluids are parenterally administerable fluids selected from the group consisting of medical fluids, nutritional fluids and mixtures thereof, distributed from a controlled atmosphere zone for sterile production of the said fluids.

9. A system according to claim 1 characterized in that the fluids are parenterally administerable fluids selected from the group consisting of medical fluids, nutritional fluids and mixtures thereof distributed from a controlled atmosphere zone for sterile production of the said fluids.

* * * * *